US005212337A

United States Patent [19]

Patteri et al.

[11] Patent Number: 5,212,337

[45] Date of Patent: May 18, 1993

[54] PLASTIC STORAGE AND TRANSPORATION CONTAINER FOR LOOSE CARTRIDGES

[75] Inventors: Matti Patteri; Jukka Juselius, both of Vantaa, Finland

[73] Assignee: Neste Oy, Finland

[21] Appl. No.: 841,423

[22] Filed: Feb. 26, 1992

[30] Foreign Application Priority Data

Feb. 28, 1991 [FI] Finland ..... 910997

[51] Int. Cl.[5] ..... F42B 39/00

[52] U.S. Cl. ..... 89/34; 206/3

[58] Field of Search ..... 89/34; 102/202.2, 282; 206/3

[56] References Cited

U.S. PATENT DOCUMENTS 3,572,499 3/1971 Mondano ..... 206/3

4,540,624 9/1985 Cannady, Jr. ..... 428/282

FOREIGN PATENT DOCUMENTS 2101559 1/1983 United Kingdom .

*Primary Examiner*—Stephen C. Bentley

*Attorney, Agent, or Firm*—Steinberg & Raskin

[57] ABSTRACT

A plastic storage and transportation container for loose cartridges, in which container static electricity arising inside the container may be conducted outside the container by a conductive fiber material disposed on the inner surface. The shell of the container is a thermoplastic tube structure. The conductive fiber material is preferably carbon fibers fixed to the inner surface of the tube structure in connection with its preparation. The cover and/or the bottom portion of the container is formed by a plug part made of a conductive plastic.

8 Claims, 1 Drawing Sheet

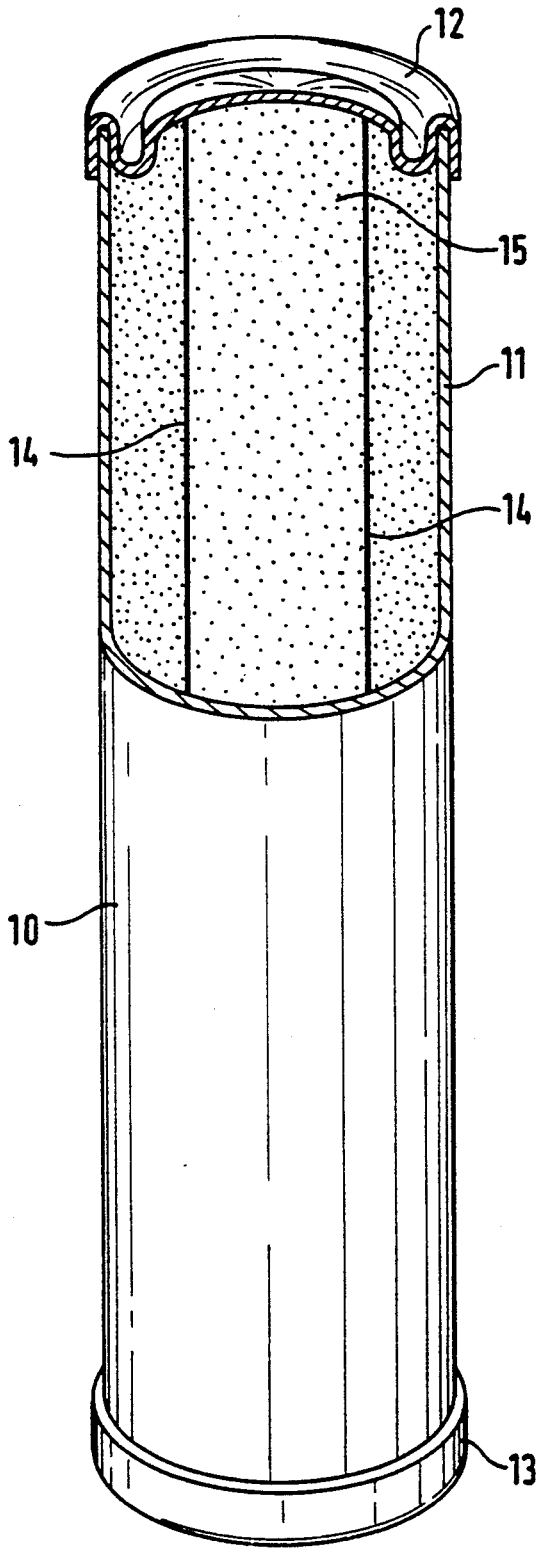
12
15
11
14
14
10
13

PLASTIC STORAGE AND TRANSPORATION CONTAINER FOR LOOSE CARTRIDGES

BACKGROUND OF THE INVENTION

The present invention relates to a storage and transportation container for loose cartridges, the shell portion of which container is comprised of a plastic material.

Loose cartridges are typically powder cartridges packed in cotton-cloth bags. Wooden or cardboard packages have usually been used for such cartridges. A problem related to such packages is a relatively low strength and a poor ability to remain dry in connection with a long-term storage. Attempts have been made to improve the moisture-resistance properties, e.g. by means of plastic coatings, but plastic coatings cause the occurrence of static electricity and its charging in the container, which causes a risk of explosion.

Loose-cartridge containers are also known, in which the case is made of thermoplastic by means of bottle, blow or rotation molding methods. However, these methods cannot provide sufficiently rigid walled tube structures, and it has not been possible to prevent the charging of static electricity in applications concerned.

Loose-cartridge containers are also known, in which attempts have been made to solve the problems caused by static electricity. One such application is described in GB application No. 2 101 559, wherein the container is comprised of fabrics or cloths containing plastic. In accordance with this publication, the charging of static electricity is prevented by placing conductive wires in the cloth fabric. These wires are connected to a suitable conductive member, e.g. a carrier handle, located outside the container, via which member the electric charges may be discharged. However, the container according to the GB publication cannot provide a sufficient strength, and furthermore, the static-electricity discharging system described is cumbersome and expensive to realize.

GB patent publication 1 277 550 also describes such a container in which the case portion is comprised of a case made of glass-fiber reinforced polyester resin. The container is mainly intended for hydrocarbon fluids, but it is also suitable for fine-grained solid material. In this publication, static electricity is collected in a metal wire structure embedded in the inner surface of the container, which structure conducts static electricity to an earthing point located outside the container.

GB patent publication 1 277 550 mainly relates to the preparation of the material to be used for the preparation of the container. The actual container is formed of this material by cutting suitable parts and by fixing and seaming the parts together. The preparation method is thus cumbersome and expensive.

SUMMARY OF THE INVENTION

The present invention relates to a storage and transporting container for loose cartridges, which container is by construction strong and formally rigid and in which the members needed for the nonconductibility of static electricity are formed simultaneously in connection with the preparation of the case portion.

For achieving the above-mentioned objects and others, the plastic storage and transportation container for loose cartridges of the present invention, in which container the static electricity arising inside the container may be conducted outside the container by means of a conductive fiber material disposed on the inner surface, is characterized in that the shell of the container is comprised of a thermoplastic tube structure, that the conductive fiber material is comprised of carbon fibers fixed to the inner surface of the tube structure in connection with its preparation and that the cover and/or the bottom portion of the container is formed by a plug part made of a conductive plastic.

DETAILED DESCRIPTION

An important aspect of the container of the present invention is that the conductive carbon-fiber wires may be placed in position in connection with the preparation of the tube. The tube may be prepared by means of various methods, such as by extrusion, pultrusion, winding, wrapping and manual lamination. In the extrusion and pultrusion methods, a matrix plastic containing glass fibers is led into an extrusion or pultrusion nozzle and continuous carbon fiber wires are simultaneously led into the nozzle such that the carbon-fiber wires remain innermost and are thus located on the inner surface of the tube forming in the nozzle. In connection with the winding, wrapping and manual lamination, the carbon fibers are positioned directly on top of the mandrel or a blank to be used in the forming of the tube, whereby the carbon fibers remain on the inner surface of the tube to be produced.

The case portion of the inventive container is especially preferably formed continuously by means of extrusion, pultrusion, winding or wrapping methods, whereby the conductive tube structure forms automatically during a single work phase.

The case portion is comprised of a tube structure made of cold-set plastic or thermoplastic and strengthened with reinforcement fibers. Cold-set plastics, such as polyester resin, are preferably used, which plastics are reinforced with any suitable fiber reinforcement in a suitable form. Suitable reinforcement fibers are fiber glass reinforcements used conventionally.

The quantity of the carbon fibers and their location on the inner surface of the tube may vary. In certain cases, even one carbon-fiber wire may be sufficient, but several wires are preferably placed in position, e.g. 2–20 pcs. No actual upper limit for the quantity of the wires exists. The carbon-fiber wires preferably pass in the direction of the longitudinal axis of the tube, but the wires may be placed to pass also circularly, which is especially suitable, e.g. in case the tube is prepared by means of winding, wrapping or manual-lamination methods. It is especially preferred that the carbon-fiber wires continue uniformly from one end to another of the tube.

The cover and bottom portion is prepared from a conductive plastic. For this purpose, e.g. internally conductive plastics may be used, such as polyacetylene or polythiophene, which have been made conductive by doping. The conductivity may also be achieved by blending a plastic raw material with a conductive material, such as carbon black, metal powder, metal fibers or carbon fibers.

When so desired, the conductivity of the inner surface of the tube may further be improved by painting the inner surface of the tube with a conductive paint, such as an aluminum floc paint.

The inventive storage and transportation container for loose cartridges is next described with reference to the fiber of the accompanying drawing, which shows the transportation container in the partially sectional view.

In the FIGURE, the transportation container is generally marked with a reference 10. The container is by cross-section comprised of a circular or polygonal tube 11 as well as of a detachable cover portion 12 and a bottomportion 13. The bottom portion 13 may be either detachable or fixed. For conducting static electricity, the inner surface of the tube 11 is provided with one or more longitudinal carbon fibers 14, which divide the charging fields smaller and conduct the charges outside the case 11 to the cover portion 12 and/or to the bottom portion 13. The cover portion 12 makes the nonconductivity of the electric charge possible such that it is comprised of a conductive plastic. Thus, no separate earthing elements are needed.

When so desired, the inner surface of the tube 11 may be painted or coated with a conductive paint or layer 15.

The examples provided above are not meant to be exclusive. Many other variations of the present invention would be obvious to those skilled in the art, and are contemplated to be within the scope of the appended claims.

What is claimed is:

1. A plastic storage and transportation container for loose cartridges, comprising a shell comprised of a thermoplastic tube structure having first and second open ends, said shell having an inner surface, a conductive fiber material comprised of carbon fibers disposed on said inner surface, said conductive fiber material being fixed to the inner surface of said tube structure during its manufacture, a covering portion attached to each of said ends of said tube structure, at least one of said covering portions comprising a plug part made of a conductive plastic, said conductive fiber material arranged to conduct static electricity arising inside said container to an outside of said container.

2. The container according to claim 1, wherein said shell is comprised of a reinforced-plastic cold-set or thermoplastic reinforced with glass fibers.

3. The container according to claim 1, wherein said carbon fibers extend continuously from one end to another of said tube structure.

4. The container according to claim 1, wherein both of said plug parts are comprised of a conductive plastic.

5. The container according to claim 1, wherein a surface layer of said plug parts is structured and arranged to be conductive.

6. The container of claim 3, wherein said thermoplastic tube structure is formed by extrusion or pultrusion, and continuous carbon fibers are simultaneously extruded or pultruded such that said carbon fibers are positioned on the inner surface of the tube structure being formed.

7. The container of claim 6, wherein said carbon fibers are arranged in the direction of a longitudinal axis of said tube structure.

8. The container of claim 3, wherein said thermoplastic tube structure is formed by winding, wrapping or manual-lamination, and said carbon fibers are arranged in a circular fashion around said inner surface of said tube structure.

* * * * *